US005361811A

United States Patent [19]

Kelley

[11] Patent Number: 5,361,811

[45] Date of Patent: Nov. 8, 1994

[54] APPARATUS FOR AND METHOD OF DISPENSING GRANULAR MATERIAL

[75] Inventor: Archie W. Kelley, Milan, Tenn.

[73] Assignee: Martin Marietta Corporation, Philadelphia, Pa.

[21] Appl. No.: 3,730

[22] Filed: Jan. 13, 1993

[51] Int. Cl.[5] ..... F42B 33/02

[52] U.S. Cl. ..... 141/250; 141/267; 141/268; 86/31; 86/33; 222/548

[58] Field of Search ..... 141/1, 250, 266, 267, 141/268, 220, 284; 222/548, 361, 365, 559, 533; 86/27, 31, 33, 20.14

[56] References Cited

U.S. PATENT DOCUMENTS

| | | | |
|---|---|---|---|
| 387,171 | 7/1888 | Lutz | 86/33 |
| 629,120 | 7/1899 | Barlow | 86/33 |
| 2,420,668 | 5/1947 | Knight | 86/33 |
| 3,004,462 | 10/1961 | Cook et al. | 86/20.14 |
| 3,047,034 | 7/1962 | Sassmannshausen | 86/31 X |
| 3,570,558 | 3/1971 | Lachaussee | 141/140 |
| 3,580,128 | 5/1971 | Leich | 86/31 |
| 3,706,257 | 12/1972 | Collman . | |
| 3,893,492 | 7/1975 | Nohren | 141/1 |
| 4,295,409 | 10/1981 | Simpson | 86/31 |
| 4,688,465 | 8/1987 | Melhus et al. | 86/20.14 |
| 4,813,331 | 3/1989 | Skerchock et al. | 86/20.12 |
| 4,856,408 | 8/1989 | Hendrickson | 86/29 |
| 4,890,535 | 1/1990 | Bieber | 86/31 |
| 4,920,853 | 5/1990 | Odom | 86/33 |
| 5,040,449 | 8/1991 | Lee | 86/27 |

*Primary Examiner*—Ernest G. Cusick
*Attorney, Agent, or Firm*—Geoffrey H. Krauss

[57] ABSTRACT

An apparatus for and method of dispensing granular material in which a flow regulator regulates the flow of grains through a fill tube is provided. A hopper assembly including a funnel and fill tube are relatively rotatable with respect to a flow regulator to facilitate the flow of grain through the flow regulator down the fill tube and cut a tip which deflects the granular material to uniformly dispense the material, for example around a cartridge. The tip rotates to further facilitate uniform distribution of granular material in the cartridge.

18 Claims, 3 Drawing Sheets

APPARATUS FOR AND METHOD OF DISPENSING GRANULAR MATERIAL

BACKGROUND OF THE INVENTION

1. Field of the Invention

The present invention relates generally to a dispensing apparatus and more particularly to a dispensing apparatus and method for loading granular propellant in cartridges or shells.

2. Related Art

The process of loading ammunition involves the placing of various materials in a cartridge or shell. These materials may be granular. When they are, the problems normally associated with the flow of granular materials may occur. These include packing and sticking in the channels of a loading apparatus. In such loading apparatus, sticking can result in periodic flow stoppages and bridging of the propellant. As a result of the flow stoppages associated with a conventional loading system, it has often been necessary to physically probe the loading apparatus to facilitate the loading. However, probing presents significant safety hazards due to the explosive and combustible nature of the propellant.

Flow stoppage often results from unbalanced distribution of the granular material within the cartridge. Generally, a projectile is located in the center of the cartridge and the granular material is loaded around the projectile. However, granular material backs up between the projectile and the dispensing end of the loading apparatus when the grain is not distributed evenly throughout the cartridge.

The rate of flow of granular material through the hopper assembly to the cartridge can contribute to flow stoppages. As the flow rate increases, the likelihood of blockage also increases.

One method employed to solve the problem of sticking associated with flow stoppage has been to vibrate the granular material to shake it loose. However, it has been found that such constant and continuous vibration can actually contribute to the settling and packing of the grain propellant. Conventional methods therefore have resulted in inefficient loading methods for loading of propellant grain into a cartridge or shell.

SUMMARY OF THE INVENTION

The present invention overcomes the aforementioned problems of the conventional systems by regulating the flow of granular material into the cartridge to be loaded. For example, the method and apparatus of the present invention is safer and faster than prior art systems. The need for physical probing is obviated without adversely effecting system throughput, thus significantly reducing the dangers associated with loading propellant into a cartridge. In fact, system throughput is increased according to the present invention.

The apparatus according to the present invention includes a frame and a hopper assembly mounted on the frame. The hopper assembly includes means for receiving granular material, an elongate fill tube coupled at one end to an outlet of the receiving means, and means, provided on another end of the fill tube, for distributing the granular material. Further, the present invention includes means, cooperatively arranged with respect to a connection of the receiving means and the fill tube for regulating flow of granular material from the receiving means to the fill tube, and means for causing relative rotation between the receiving means and the regulating means. The receiving means may be a funnel having an upwardly-directed mouth.

In one embodiment, the regulating means has a substantially cylindrical element with an axis coincident with an axis of rotation of the hopper assembly. The cylindrical element has a circumferential portion spaced away from an inner surface of the funnel to form a portion of a gap between the funnel and the regulating means which is sufficiently small that a grain of granular material is substantially prevented from passing therethrough, and a chordal portion which forms an aperture portion of the gap with an adjacent portion of the inner surface of the funnel, the aperture being sufficiently wide to admit at least one grain of granular material.

The flow regulator of the present invention is designed to limit the amount of granular material which can pass from the hopper assembly through the fill tube and into the cartridge. The aperture portion of the gap formed by the chordal portion can be set to a desired size for specific regulation needs while the remaining portion of the gap formed by the circumferential portion must be sized appropriately so that no granular material can pass through.

BRIEF DESCRIPTION OF THE DRAWINGS

The present invention will now be described in more detail with reference to preferred embodiments of the present invention, given only by way of example, and illustrated in the accompanying drawings, in which.

DETAILED DESCRIPTION OF THE PREFERRED EMBODIMENTS

While the following description is in the context of munitions systems, it will be understood by those skilled in the art that the present invention may be used in other applications as well.

Figure 1:
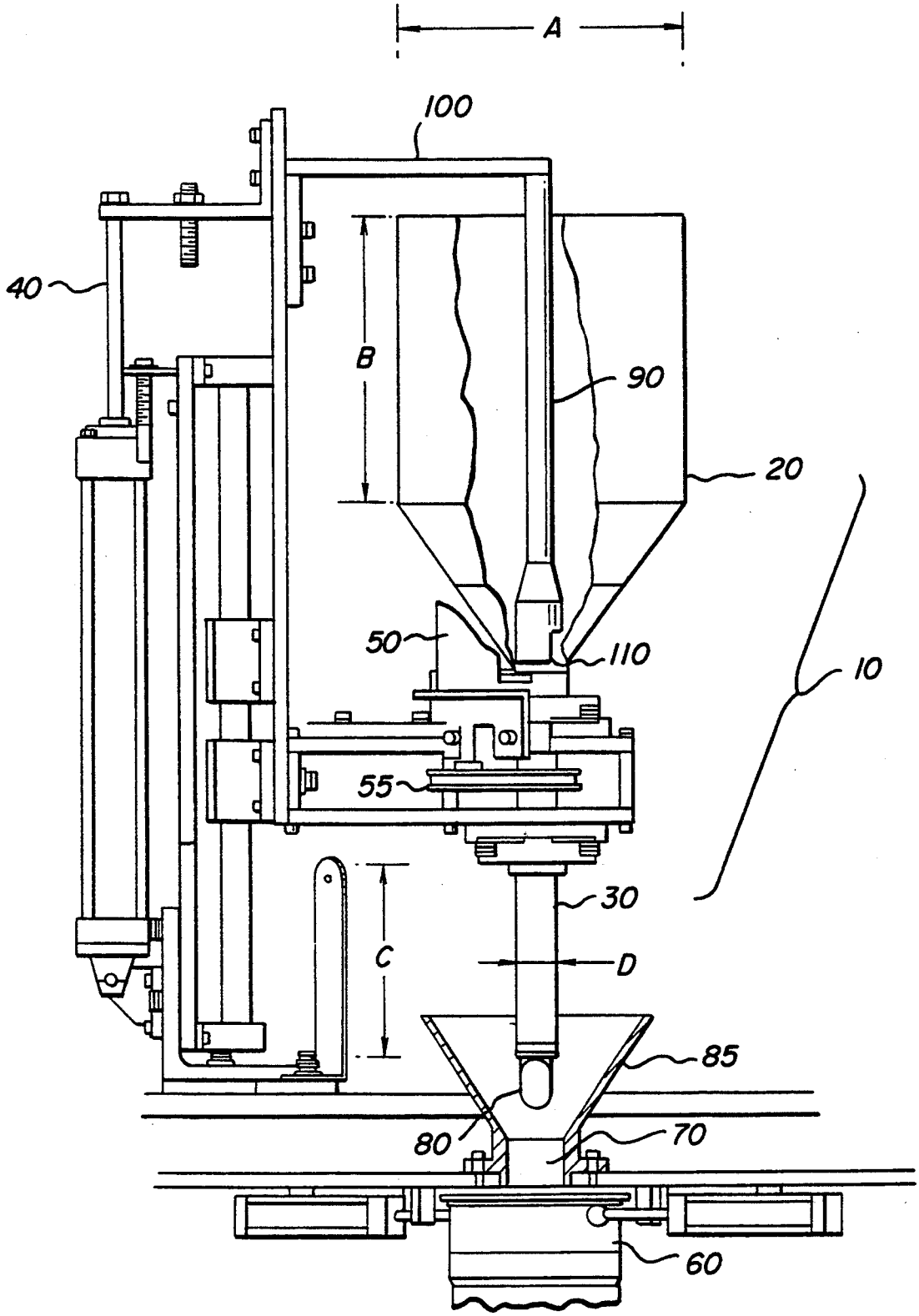
FIG. 1 is a front, partially cutaway view of an exemplary loading system according to a presently preferred embodiment of the present invention.

FIG. 1 is a front, partially cutaway view of a granular loading mechanism of the present invention. In a preferred embodiment, a complete load system includes twelve individual loading mechanisms operating in two banks of six. A hopper assembly 10 including a funnel 20 and a fill tube 30 is mounted to a frame 40. The funnel 20 and the fill tube 30 are coupled, e.g., threaded together at the funnel throat. A rotary driving means, preferably a motor 50, drives a tension belt 55 which causes the hopper assembly 10 to rotate. Granular material is loaded into the funnel 20 to be dispensed to a cartridge 60. The dimensions of the funnel 20 and the fill tube 30 for a presently preferred embodiment are approximately ten inches for the diameter of the funnel 20 (designated by the letter "A"), ten inches for the depth of the upper section of the funnel 20 (designated by the letter "B"), eighteen inches for the length of the fill tube 30 (designated by the letter "C"), and 1.5 inches for the diameter of the fill tube 30 (designated by the letter "D").

It should be noted that while in the present embodiment the funnel 20 is comprised of an upper cylindrical section and a lower conical section, it will be apparent to one of ordinary skill in the art that other configurations, such as a completely conical configuration, may be used.

The cartridge 60 is loaded with propellant grain, preferably coated with graphite, to propel a projectile arranged inside. To maximize the propulsion imparted by the propellant grains, it is important to load a preweighed charge of propellant into the cartridge 60.

Figure 2:
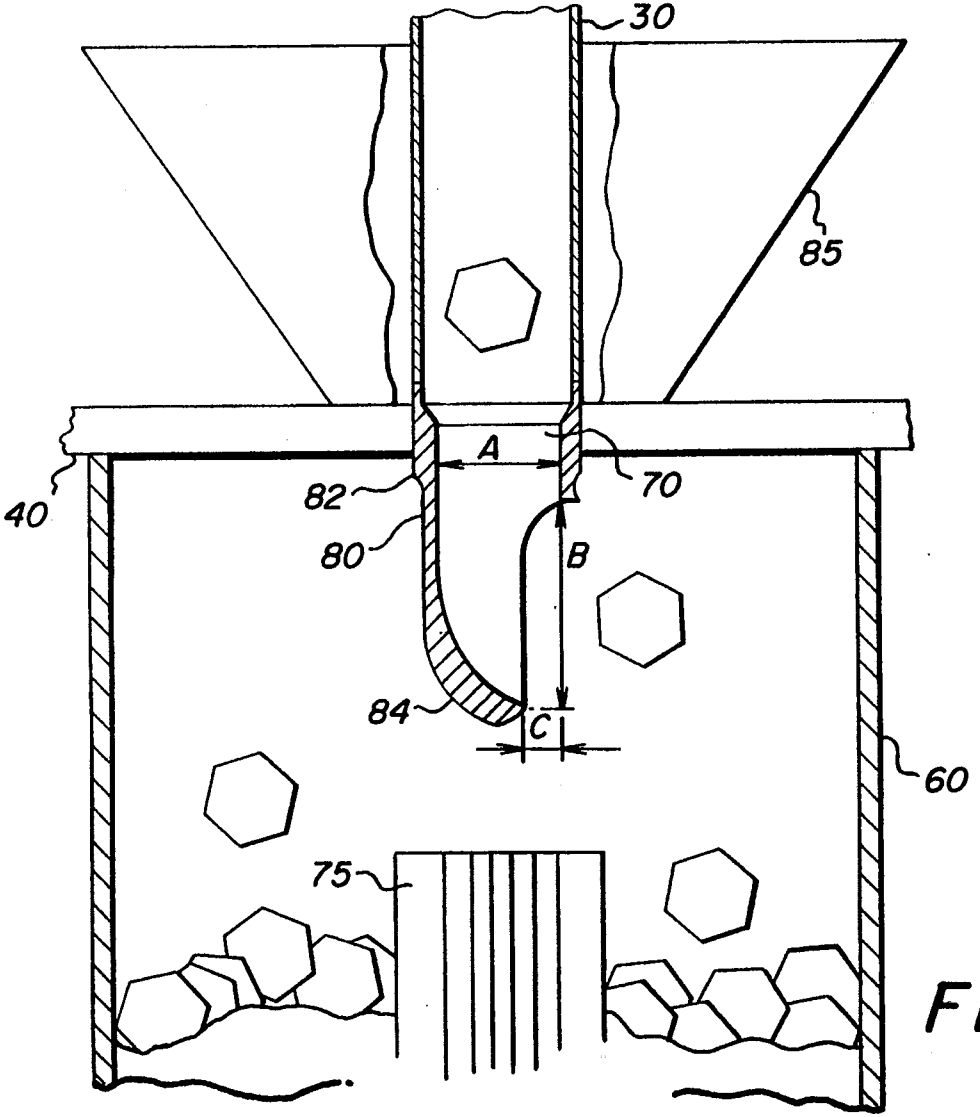
FIG. 2 is a front, cutaway view of a section of the embodiment of FIG. 1.

Referring to FIG. 2, the hopper assembly 10 is inserted into a funnel 85 above the cartridge 60 and through a primer hole 70 into the cartridge 60 for loading the granular material. Specifically, an end portion of the fill tube 30 is inserted into the cartridge 60 as shown. Attached to the end of the fill tube is a tip 80. The tip 80 is designed to deflect the grains radially while rotating. The tip 80 is coupled to the fill tube 30, for example threaded to the fill tube 30, so that when the tip 80 rotates, grains are deflected into a circumferential portion of the cartridge 60 thereby filling an annular space between a projectile 75 inside the cartridge 60 and the inner surface of the cartridge 60.

The tip 80 eliminates flow stoppages caused by a projectile inside the cartridge 60. Without the tip 80, the granular material often tends to clog up between the fill tube discharge area and the projectile. This results in decreased efficiency in the loading of the cartridge 60. By rotating the tip 80 during the loading process, the loading efficiency associated with loading granular material into cartridges is improved.

The tip 80 includes a cylindrical portion 82 and a spoon-shaped portion 84. A conductive plastic (e.g., polyethylene) sleeve (not shown) is placed around cylindrical portion 82 to prevent metal to metal contact between the tip 80 and the cartridge 60. Grain sizes vary depending on the requirements of the cartridge 60. For example, in an embodiment for a hexagonally shaped grain with a length of approximately 0.75 inches, the dimensions of the tip 80 are the following: 1) an inner diameter of approximately 1.04 inches for the cylindrical portion 82 as shown by A in FIG. 2; 2) a height from the bottom of the spoon-shaped portion 84 to the cylindrical portion 82 of approximately 1.92 inches represented by B in FIG. 2; and 3) a distance from the end of the spoon-shaped portion 84 approximately 0.39 inches from a line extending downward from the cylindrical portion 82 as shown by C in FIG. 2.

Flow stoppages and blockages are not limited only to the area inside the cartridge 60, but can result throughout the hopper assembly 10 in conventional systems. To further facilitate the flow of granular material into the cartridge 60, the present invention employs a flow regulator 90 to regulate the flow of granular material from the funnel 20 into the fill tube 30 and down into the cartridge 60. The flow regulator 90 is attached, e.g., welded, to a rod member 100 which is connected to the frame 40. The flow regulator is inserted into the center of the funnel 20 of the hopper assembly 10. The rod member 100 can be raised or lowered, for example by an air cylinder located between steel plates in the frame 40, to set the flow regulator 90 at a desired height within the funnel 20.

Figure 3:
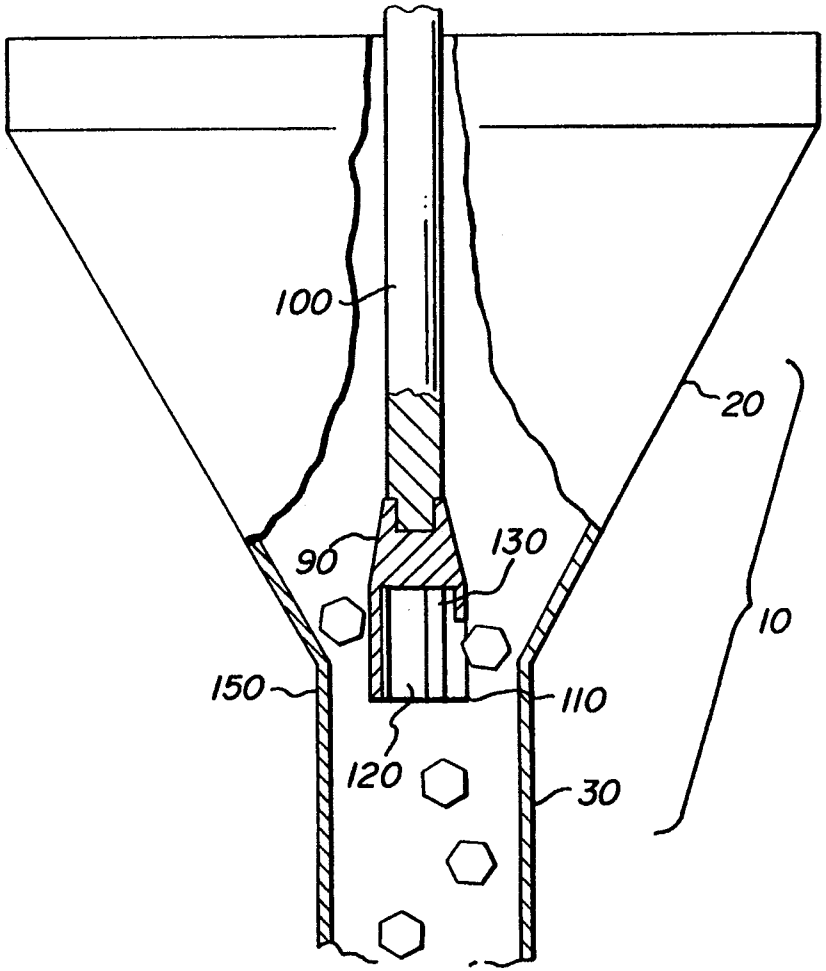
FIG. 3 is a cross sectional view of the flow regulation section of the embodiment of FIG. 1.
Figure 4A:
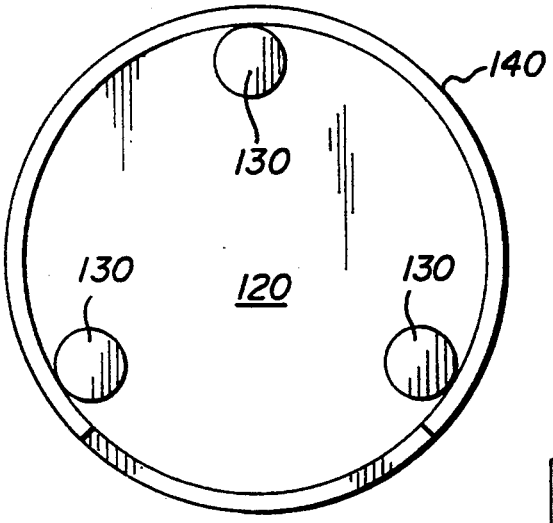
FIGS. 4*a*, 4*b*, and 4*c* are bottom, side, and perspective views, respectively, of the flow regulation section of the embodiment of FIG. 1.
Figure 4B:
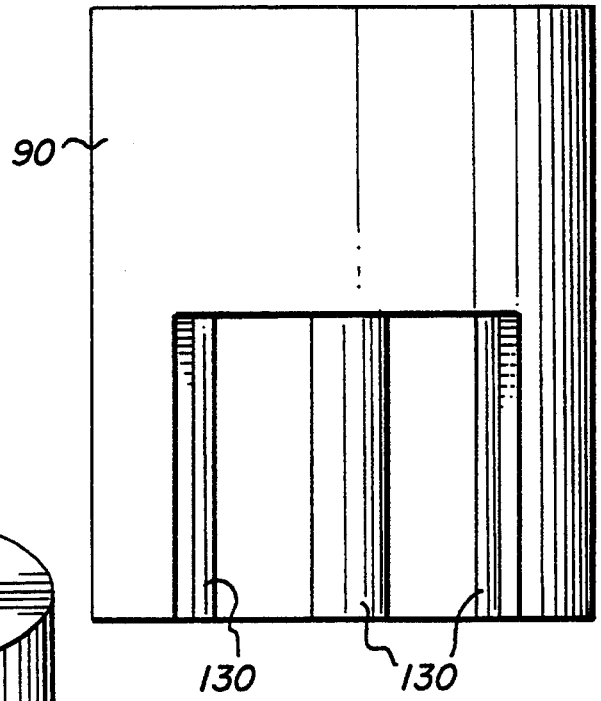
Figure 4C:
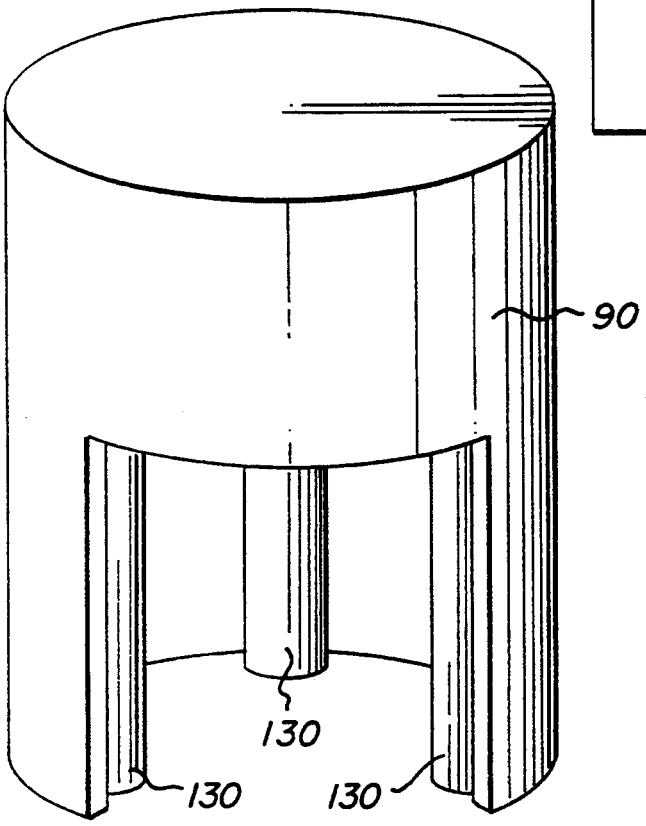

In one embodiment shown in the cross section view in FIG. 3, the flow regulator 90 is cylindrically shaped. However, at the base of the flow regulator 90, the end inserted into the funnel 20, a portion of the cylinder is cut out creating an aperture 110 which opens into a cavity 120. Located inside the cavity 120, as shown in FIGS. 4a–4c, are three posts 130 attached to the inner circumference of the cylindrical portion 140 of the regulator 90. Preferably the posts 130 are spaced equidistant from each other along the inner circumference of the cylindrical portion 140. The posts 130 facilitate the flow of granular material by minimizing bridging of the grains. Preferably, the aperture 110 is cut out to be equidistant from the two adjacent posts 130.

The aperture 110 is appropriately sized to allow for granular material to flow from the funnel 20 through the aperture 110 and down into the fill tube 30 and then into the cartridge 60. The flow regulator 90 does not contact the inner circumference of the funnel 20. Thus, a gap 150 is created between the base of the flow regulator 90 and the inner circumference of the funnel 20 which includes the aperture 110. The size of the gap 150 is determined by adjusting the height of the flow regulator 90 within the funnel 20 for the best flow, i.e., raising or lowering the flow regulator 90 within the funnel 20. However, the gap 150 is sufficiently small so that granular material cannot pass between the flow regulator 90 and the inner circumference of the funnel 20 unless that material is located in the gap 150 at the aperture 110 which has an opening large enough to allow for grains to flow through.

The flow regulator 90 can be shaped in any manner as long as the only portion of the flow regulator through which granular material can pass is the portion of the gap 150 where the aperture 110 is located. The aperture 110 of the gap 150 can be sized appropriately to allow for only a single grain to pass through or to allow a plurality of grains to pass through depending on the desired loading parameters.

In a presently preferred embodiment, for a hexagonally shaped grain with a length of approximately 0.75 inches, the dimensions of the flow regulator are as follows: a cavity 120 with approximately a 1.5 inch circumference and a 1.5 inch depth, an aperture 110 with approximately a 1 inch width and a 1.125 inch depth, and three posts, each having a 0.25 inch diameter.

The hopper assembly 10, including the funnel 20, fill tube 30 and tip 80, is caused to rotate by the belt 55 driven by the motor 50 in a presently preferred embodiment. Through this driving, the granular material in the funnel 20 is rotated around the flow regulator 90 thereby allowing the granular material to be dispensed through the aperture 110. The flow regulator 90 is stationary. The gap 150 is sufficiently large such that when the hopper assembly 10 rotates, it is ensured that the flow regulator 90 does not rotate. Thus, when granular material is located at the aperture 110, it will fall through the aperture 110 and into the fill tube 30. The granular material may flow like sand, for example, through the aperture 110.

The flow regulator 90 and the funnel 20 need only be in relative rotation such that either one or both can be driven to rotate. However, if both are driven to rotate, they are better driven at different rates (revolutions per minute), preferably in opposing directions, to ensure efficient grain loading. All combinations of separately and jointly rotatable components are considered within the scope of the present invention.

The flow regulator 90 not only minimizes blockages and flow stoppages of granular material in the funnel 20, but also helps to minimize flow stoppages at the cartridge 60. Specifically, with the flow regulator 90, a prescribed number of grains will flow from the funnel 30 into the fill tube 30. Consequently, the potential for flow stoppage in the cartridge area is further reduced.

The aperture 110 of the flow regulator 90 can be designed so that it is manually or automatically adjustable. Further, it can be designed such that it can be removed and easily replaced, for example for different grain sizes.

The loading system can be particularly adapted to loading propellant grains for 120mm tank ammunition. An exemplary individual hexagonal grain for such an application is hexagonal in cross section, with a vertex to opposed vertex dimension of approximately 0.6 inches.

While particular embodiments of the present invention have been described and illustrated, it should be understood that the invention is not limited thereto since modifications may be made by persons skilled in the art. The present application contemplates any and all modifications that fall within the spirit and scope of the underlying invention disclosed and claimed herein.

What is claimed is:

1. An apparatus for loading granular material, comprising:

means for receiving said granular material, said receiving means having an inlet and an outlet;

a fill tube having one end coupled to said outlet of said receiving means;

means cooperatively arranged with respect to said outlet of said receiving means for regulating flow of said granular material from said receiving means to the fill tube; said flow regulating means including a rod having a structure defining a cavity formed in a side portion thereof for allowing the granular material to flow from said receiving means to said fill tube;

means for causing relative rotation between said receiving means and said regulating means; and means, including a tip having a substantially spoon-shaped portion, coupled to another end of said fill tube for distributing said granular material into a cartridge.

2. The apparatus of claim 1 wherein said receiving means comprises a funnel having an upwardly-directed mouth and joining said fill tube at its base.

3. The apparatus of claim 2, wherein said rod is suspended within said funnel to form a gap between said cavity and an inner circumference of said funnel, said structure defining said cavity forming an aperture with an area sized to allow granular material to pass through, a remaining portion of said rod being sized to prohibit granular material from passing through.

4. The apparatus of claim 3 wherein only a single grain can pass through said aperture at any one time.

5. The apparatus of claim 3 wherein a plurality of grains can simultaneously pass through said aperture.

6. The apparatus of claim 1 wherein said rod includes a flow regulator for allowing a set amount of granular material to pass from said receiving means into said fill tube.

7. The apparatus of claim 6 wherein said set amount is one grain.

8. The apparatus of claim 1 wherein said distributing means is inserted through a funnel portion for loading said granular material into said cartridge.

9. The apparatus of claim 8 wherein at the base of said funnel portion is a primer hole for receiving said distributing means.

10. The apparatus of claim 1, wherein a portion of said cavity is arranged inside said fill tube.

11. The apparatus of claim 10, further comprising means for adjusting a portion of said cavity which is arranged outside of said fill tube.

12. The apparatus of claim 1, wherein said cavity is semicircular.

13. The apparatus of claim 1, further comprising means for causing relative rotation between said tip and said cartridge.

14. An apparatus for loading granular material, comprising:

means for receiving said granular material, said receiving means comprising a funnel having an upwardly directed mouth as an inlet and abase as an outlet;

a fill tube having one end coupled to said outlet of said receiving means;

means cooperatively arranged with respect said outlet of said receiving means for regulating flow of said granular material from said receiving means to the fill tube;

means for causing relative rotation between said receiving means and said regulating means; and wherein said regulating means comprises a substantially cylindrical element with an axis coincident with an axis of rotation of said hopper assembly, and having a first circumferential portion spaced away from an inner surface of said funnel to form a first portion of a gap which is sufficiently small that a grain of said granular material is substantially prevented from passing therethrough; and a chordal portion, said chordal portion forming a second portion of said gap with an adjacent portion of the inner surface of said funnel which is sufficiently wide to admit at least one grain of said granular material.

15. The apparatus of claim 14, said regulating means further including a plurality of posts, coupled to said circumferential portion, for preventing bridging of granular material.

16. The apparatus of claim 15 wherein said posts are spaced equidistant from each other along said circumferential portion.

17. The apparatus of claim 15 wherein said second portion of said gap is equidistant from two of said posts.

18. An apparatus for loading granular material, comprising:

means for receiving said granular material, said receiving means having an inlet and an outlet;

a fill tube having one end coupled to said outlet of said receiving means;

means cooperatively arranged with respect said outlet of said receiving means for regulating flow of said granular material from said receiving means to the fill tube means for causing relative rotation between said receiving means and said regulating means; and wherein said regulating means is coupled to said frame with a support means, a position of said support means being adjustable with respect to said frame for adjusting the location of said regulating means within said hopper assembly.

* * * * *